US005456546A

United States Patent [19]

Bollag

[11] Patent Number: 5,456,546

[45] Date of Patent: Oct. 10, 1995

[54] REFLECTIVE BODIES MADE OF TRANSPARENT MATERIAL TO BE APPLIED ON TRAFFIC SURFACES OR TRAFFIC GUIDING SURFACES

[75] Inventor: Moses Bollag, Geneva, Switzerland

[73] Assignees: Plastiroute S.A., Geneva, Switzerland; Potters-Ballotini Ltd, Barnsley, United Kingdom

[21] Appl. No.: 140,190

[22] PCT Filed: Feb. 24, 1993

[86] PCT No.: PCT/CH93/00047

§ 371 Date: Nov. 5, 1993

§ 102(e) Date: Nov. 5, 1993

[87] PCT Pub. No.: WO93/18233

PCT Pub. Date: Sep. 16, 1993

[30] Foreign Application Priority Data

Mar. 6, 1992 [CH] Switzerland ..... 00723/92
Mar. 6, 1992 [CH] Switzerland ..... 00724/92

[51] Int. Cl.[6] ..... E01C 9/00

[52] U.S. Cl. ..... 404/9; 404/14; 404/17

[58] Field of Search ..... 404/12, 14, 16

[56] References Cited

U.S. PATENT DOCUMENTS

| | | | |
|---|---|---|---|
| 3,005,790 | 10/1961 | Wynn et al. | 404/14 |
| 3,215,051 | 11/1965 | Gill | 404/14 |

FOREIGN PATENT DOCUMENTS

| | | |
|---|---|---|
| 0177181 | 9/1985 | European Pat. Off. . |
| 0322671 | 12/1988 | European Pat. Off. . |
| 1386085 | 12/1964 | France . |
| 2011238 | 12/1971 | Germany . |
| 2216157 | 11/1972 | Germany . |
| 562372 | 5/1975 | Switzerland . |

*Primary Examiner*—Ramon S. Britts
*Assistant Examiner*—Pamela A. O'Connor
*Attorney, Agent, or Firm*—Kane, Dalsimer, Sullivan, Kurucz, Levy, Eisele and Richard

[57] ABSTRACT

Reflective bodies (6, 7) made of a transparent material are provided at their surface with distributed color spots (8), so that light can enter and exit the reflective bodies with enough intensity to generate a retroreflection. These reflective bodies are to be applied on road or other traffic surfaces, on road markings or on traffic guiding surfaces in order to make them visible, in particular at night or in rain.

7 Claims, 2 Drawing Sheets

FIG. 1
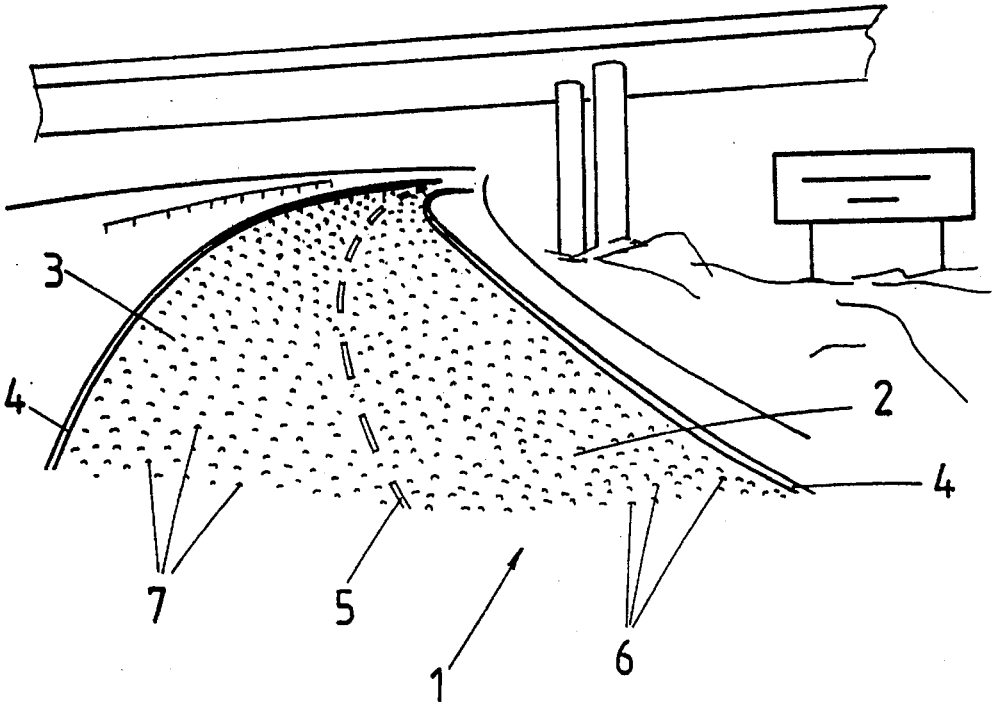
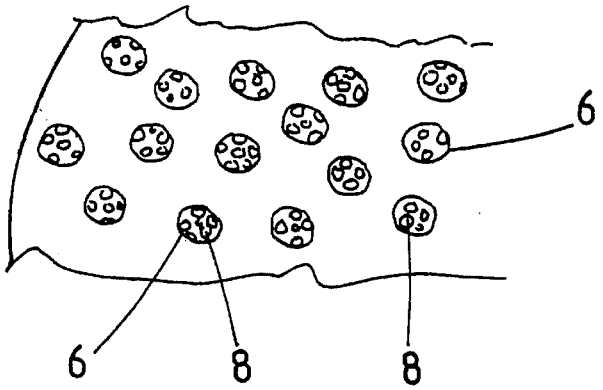
FIG. 2
FIG. 3
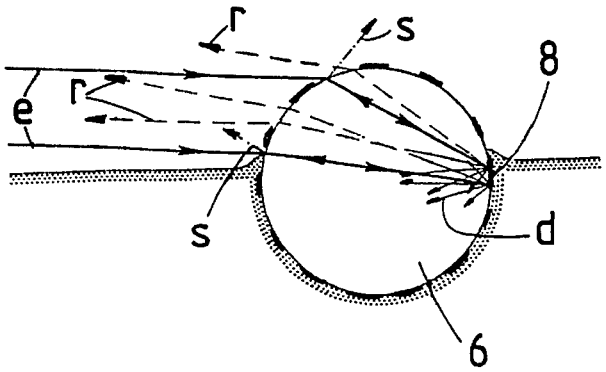

REFLECTIVE BODIES MADE OF TRANSPARENT MATERIAL TO BE APPLIED ON TRAFFIC SURFACES OR TRAFFIC GUIDING SURFACES

The invention relates to reflecting bodies made from transparent material for mounting on traffic-bearing surfaces, in particular roads, or on traffic control surfaces, to a method for producing these reflecting bodies and to the use of the same.

So far, reflecting bodies have been known in the form of colorless, transparent glass beads or reflecting beads, which are mounted on horizontal markings, in particular on marking lines, which delimit the lanes. These reflecting beads enhance the night-time visibility of the horizontal marks in the headlamp light of the car. Such reflecting beads and their application to better visualization of horizontal markings are disclosed, in particular, in EP-B-0,280,102 from the same applicant.

Furthermore, FR-A-1,386,085 discloses the provision of glass beads directly on the surface of the pavements, which are partially embedded in the pavement, so that they project from the roadway by a spherical segment and enhance the night-time visibility of the same by reflection of the headlamp light. In this case, it is also mentioned that colored glass beads can be used in order, for example, to color-mark particular route guides.

The visibility of reflecting beads on horizontal markings or pavements in the headlamp light of a car is based essentially on so-called retroreflection, and not on specular reflection at the outer surface of the reflecting beads. Retroreflection is understood as reflection in which the incident light is reradiated in the direction towards the light source. This effect, which will be illustrated more effectively later with the aid of FIG. 3 and is based on refraction and reflection, is produced by those incident light beams which penetrate into the glass bead, experience refraction in the process and reexit from the glass bead on the incident side after internal reflection accompanied by renewed refraction. Since reflecting surfaces oriented perpendicular to the direction of illumination are present seldom or virtually not all, when the reflecting beads are embedded for the purpose of effective adhesion at least by half in the pavement, the light specularly reflected at the outer surface of a reflecting bead is retroreflected largely upwards and not in the direction of illumination, that is to say not to the driver of the car concerned. Consequently, it is virtually exclusively the retroreflection which is decisive for the desired night-time visibility.

However, when mentioning the colored glass beads, the said FR-A-1,386,085 does not explain how an effective retroreflection is to be achieved therewith. If the glass beads are coated with a colored film which transmits virtually no light, no retroreflection can take place. If the glass beads consist of colored glass, the intensity of the retroreflected light beams is more or less attenuated, in accordance with the reduced optical transparency of the material. Furthermore, the background color, that is to say the generally black or dark gray color of the pavement, covers the natural color of the glass beads. These disadvantages have meant that this method in accordance with FR-A-1,386,085 from the year 1964 has attained no practical importance.

Numerous other attempts and means are known for improving road markings: EP-A-0,177,181 describes ceramic microspheres which contain metal oxides and are embedded in marking strips which are, as prefabricated elements, intended for mounting on roadways. EP-A-0,322, 671 proposes a pigmented horizontal marking in which clusters are contained which consist of a core and of microspheres which surround this core and are embedded in a transparent binding agent. DE-A-2,216,157 discloses a cover material for roads in the form of a combined composition made from silicon carbide and glass beads. The use of silicon carbide for producing reflecting road surfaces is described in CH-A-562,372.

In DE-A-2,011,238 of the same inventor, originating from the year 1970, it was proposed to provide reflecting bodies with phosphorescent luminescent particles, in order to provide a self-luminous marking which is visible in darkness even outside the illuminating cone of the car headlamp. This idea did not lead to any practical application, because the self-luminous effect is too slight outside the headlamp light and useless in the glaring headlamp light.

The present invention is based on the object of providing reflecting bodies by means of which the visibility of roads or other traffic-bearing surfaces, of lanes, or of traffic control surfaces and, in particular, the visibility of the envisaged traffic control can be improved in a simple and cost effective way, above all at night and when wet.

For this purpose, the reflecting bodies according to the invention are defined in that their circumference is partially covered by paint, the free surface that remains uncovered sufficing to cause incident light to enter the reflecting bodies with an intensity sufficient to produce retroreflection, and to exit from the reflecting bodies.

These reflecting bodies can consist of glass or plastic, in particular of customary reflecting beads having diameters of, preferably, 0.4 mm to 6 mm, and the paint can either cover a coherent surface region of the reflecting body, in the case of spherical reflecting bodies a cap-shaped or approximately hemispherical region, or a plurality of mutually separate, discrete colored surface regions can be provided on a reflecting body. It is essential that a sufficiently large colorless surface region remains free, or so many colorless surface regions remain free that the headlamp light of the car can enter into the reflecting bodies unhindered and is retroreflected sufficiently strongly in the paint of the painted reflecting bodies. For this purpose, the paint-covered surface of a reflecting body is preferably only 30 to 70%, in particular approximately 50%, of the total surface.

It is important here that the effect achieved by means of reflecting bodies according to the invention is based on chromatic retroreflection, that is to say the combination of refraction and internal reflection inside transparent, colorless material, and is effective without limitation independently of the background color (for example black or white); by contrast, with reflecting bodies which themselves consist of colored material, or with reflecting bodies completely covered by paint, this effect cannot be achieved.

Expedient embodiments of the invention follow from the dependent claims, in particular methods are specified for producing reflecting bodies in claims 9 and 10.

The use of reflecting bodies according to the invention is defined in that reflecting bodies are introduced into the surface of the pavement of roads or other traffic-bearing surfaces, or on a horizontal marking. As a result, traffic control can be visualized by means of points appearing in color in the headlamp light of the car, selection particularly being made of those colors which contrast effectively with the dark or black background of the pavement. This enhances, in particular, traffic safety on narrow roads of third and fourth classes, on winding roads, in mountains and in tunnels. It is also possible for existing horizontal markings in the form of continuous or broken lines or else merely the shoulders of roads, in particular the hard shoulders of freeways, to be laid with reflecting bodies according to the invention.

The invention is explained in more detail with the aid of the drawings and of an exemplary embodiment.

FIG. 1 shows the diagrammatic representation of a two-lane roadway of a freeway, which is laid with reflecting bodies according to the invention in the form of reflecting beads;

FIG. 2 shows a diagrammatic, enlarged top view of the pavement laid with reflecting beads, these reflecting beads being provided with small patches of paint, and FIG. 3 shows, for the purpose of illustrating the retroreflection, a diagrammatic representation of a reflecting bead according to the invention, which projects on the roadway surface.

Figure 4:
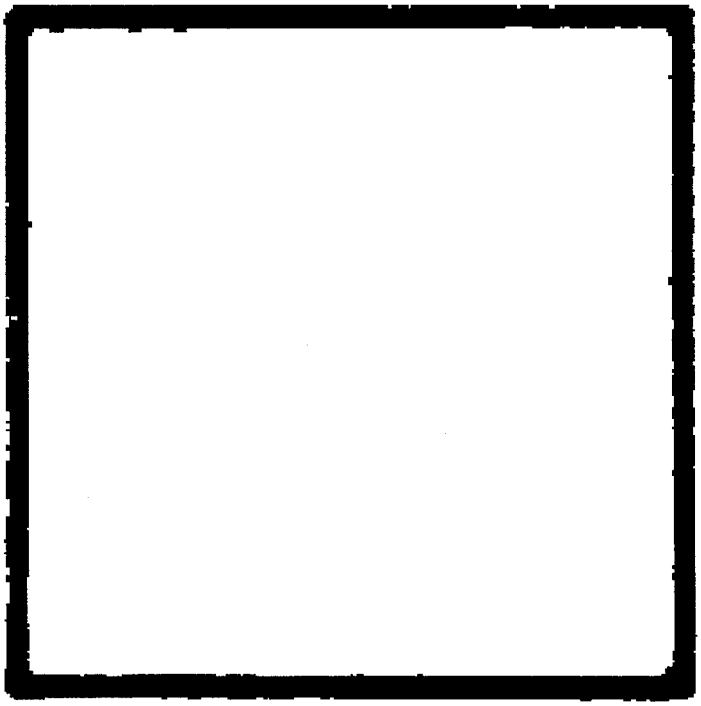
FIG. 4 shows a reflecting body having a polyhedron shape.

FIG. 1 shows diagrammatically a roadway 1 of a freeway having the two lanes 2 and 3, the continuous lateral delimiting lines 4 and the broken center line 5. The road surface of the two lanes 2 and 3 is provided with the reflecting beads 6 and 7, respectively, which have been introduced into the pavement.

As FIG. 2 illustrates diagrammatically, the reflecting beads are provided on their circumference with discretely distributed colored surface regions 8 in the form of patches of paint which leave free sufficient glass surface for the retroreflection in the headlamp light of a car to be maintained, but for this retroreflected light to appear correspondingly colored.

This effect is to be illustrated with the aid of FIG. 3: it shows a reflecting bead 6 which is partially embedded in the pavement of the roadway 1 and has patches of paint 8 distributed separately over its circumference. The bold unbroken lines e show light beams which are incident in the direction of the arrows and produced by car headlamps and are partially reflected specularly at the surface locations free from patches of paint, as indicated by the thin dashed and dotted lines s; however, these incident light beams e are refracted when entering the reflecting bead, experience internal reflection at the opposite boundary surface thereof, and exit again in the direction towards the light source after renewed refraction at the incident side. These retroreflected light beams r represented by means of thin unbroken lines are responsible for the main effects of night-time visibility. In addition, diffusely reflected light beams d are further represented by means of thin continuous lines.

It is obvious that the retroreflection effect previously explained can become active only where the incident light beams e enter the glass bead at paint-free locations and the retroreflected light beams r can exit from the glass bead at paint-free locations. On the other hand, a colored back reflection, which contrasts effectively, in particular, with the dark or black background of the pavement, becomes fully effective only if the light beams entering the reflecting bodies are reflected internally at locations on the boundary surface whose outside is provided with patches 8 of paint. A reflecting bead completely covered by paint would therefore be absolutely unable to produce the desired effect, since the essential retroreflection cannot take place in the interior of the glass bead.

Naturally, the light which is retroreflected at locations of the boundary surface at which there are no patches of paint also appears colored, because the entire reflecting bead is more or less lit up in a colored fashion as a whole by diffuse reflection at the boundary surfaces covered by the patches of paint. The main colored effect is based, however, on the internal reflection at the locations of the boundary surfaces that are provided on the outside with patches of paint.

To render the colored effect sufficiently clear, the colored surface regions should not be punctiform, but should have a certain extent. Good effects have been produced, for example, using reflecting beads of 1 to 2 mm diameter, in which the preponderant number of colored surface regions was at least approximately 0.01 $mm^2$, that is to say represented patches of paint having minimum diameters of approximately 0.1 mm, and in which the surface of a reflecting body that was covered by paint was approximately 50% of the total surface. As sampling tests showed, the number of discrete patches of paint per reflecting bead was approximately 50 to 200, depending on the size of the reflecting bead. Naturally, in practice when the paint is applied patches of paint of different size are produced, it being the case that impinging, virtually punctiform paint splashes such as occur when a spray of paint is generated, run on the surface of the reflecting body to produce more or less extended patches of paint, depending on the type of paint. The minimum extensions of the patches of paint that are required to achieve a sufficiently clear colored effect are thus produced in practice largely automatically when the paint is applied.

The diameter or the largest dimension of the reflecting bodies used preferably varies from 0.4 to 6 mm, in particular from 1 to 3 mm; their refractive index is preferably 1.5 to 1.7. It has emerged that reflecting bodies in which the surface covered by paint of a reflecting body was 30% to 70%, preferably approximately 50%, of the total surface yield good effects, more than half of all the patches of paint of a reflecting bead having minimum sizes of approximately 0.1 $mm^2$; mostly, the greatest part of all the patches of paint of a reflecting bead had this minimum extent.

An interesting embodiment of reflecting bodies according to the invention results when paint is applied only from one side to spherical reflecting bodies in such a way that most of them obtain only a single coherent colored zone in the form of a colored spherical cap, preferably a hemispherical surface. When such reflecting bodies are mounted on the roadway, statistically approximately 50% of them then acquire an orientation such that at least a proportion faces the uncovered, colorless surface of the light source, that is to say the car headlamp, and thus produces a particularly strong chromatic retroreflection, since virtually the entire incident light experiences internal reflection at the opposite colored surface region. The other half of these reflecting bodies, whose colored surface region points in the direction of the light source does not, it is true, contribute to the retroreflection, but ensures a particularly clear colored marking in daytime.

The color of the reflecting beads 6 on the lane 2 can be different from the color of the reflecting beads 7 on the lane 3.

Reflecting bodies of different color can advantageously also be used on normal highways having oncoming traffic or in tunnels, in order to distinguish by color the roadway or lane in the one direction from the roadway or lane in the other direction. This is important, in particular, on roads which because of their narrowness have no marking lines or other markings. Here, reflecting bodies in accordance with the invention permit effective visualization of the line guides or of the lanes to be observed.

It is also advantageously possible to use reflecting bodies having a color differing from the color of the reflecting bodies covering the main lane to mark road junctions, freeway junctions, freeway approaches and freeway exits in such a way that the merging lane or the lane branching off appears in a different color from the main lane. Furthermore, the sections of the roadway in front of stopping points or in front of a tunnel can be marked by reflecting bodies having a particular color, in particular having a red color.

Furthermore, road sections in fog zones can be marked by colored reflecting bodies. In fog, headlamp light is not only diffusely reflected, but reflected in a colored fashion for the purpose of visualizing the traffic control.

The paints used to color the reflecting beads can, for example, be green, yellow, blue, pink, red, orange, gray etc., it being possible, furthermore, to use bright and dark color tones, or it is also possible to use metallic paints, such as silver enamel.

It is essential in each case that use is made of a color contrasting with the background of the pavement; as a result, the irradiated reflecting bodies have an effective visual contrast with the generally dark background or, when wet, with the color of the water, which appears gray, and this ensures night-time visibility. Whereas in the case of colorless reflecting bodies the dark pavement, in particular the dark bitumen, shines through, reflecting bodies provided with spots of color have the further advantage that the dark road background does not shine through at the locations of the color, and this increases the color contrast. If necessary, it is also possible to use reflecting beads of different colors for marking specific lane sections, so that in this case the lane irradiated by the headlamp appears colored.

It is also possible to provide spots of color having two or more different colors, for example green and yellow, for one and the same reflecting body. In this way, it is possible, for example, to mark transition zones or overlaps between a main lane in, for example, a green color and a branch-off in, for example, a yellow color by means of two colors, specifically green and yellow.

Reflecting bodies according to the invention can advantageously also be mounted on horizontal markings, in particular continuous or interrupted marking lines, where they complement the previously customary colorless reflecting beads.

It is also possible to lay prohibitive cross hatchings or traffic control surfaces with colored, for example red-flecks, reflecting bodies.

The application of reflecting bodies in the production of pavements can be performed in different ways, depending on the type of pavement:

If it is a question of bituminous road surfaces that are to be laid new, the simplest type of mounting is to scatter the reflecting bodies onto the freshly laid asphalt pavement and press them into the still hot pavement using the multi-rubber-tire roller. This holds for asphalt pavements of any type. In this case, both the macro-rigorousness of the finished pavement and the selected diameter of the reflecting bodies are irrelevant, since reflecting bodies having a size of from 5 to 6 mm, for example, can also be pressed into the still soft asphalt composition. The circumstance that a small proportion of the reflecting bodies are possibly crushed in the process by the rollers is not a disadvantage, since broken reflecting bodies act as pavement-gripping agents.

The best results are obtained, however, when the largest dimension or the largest diameter of the reflecting bodies is not larger than the highest surface roughness of the pavement, so that the diameter of the reflecting bodies should also be selected in accordance with the surface roughness to be expected. The circumstance that during rolling in the reflecting bodies are partially coated with a thin layer of binding agent is irrelevant, since thin layers of binding agent are quickly worn off by traffic, and also weather quickly under the influence of UV radiation.

It is also possible for bituminous pavements already bearing traffic to be provided subsequently with reflecting bodies. The maximum diameter of the selected reflecting bodies must then be smaller than the maximum surface roughness of the pavement.

When laying a pavement made from fresh concrete surfaces, the procedure is such that reflecting bodies are mounted on the as yet unset freshly mixed concrete, where they will sink in or be pressed in depending on the viscosity of the still damp surface. In this process, a partial coating with cement mortar is unavoidable, but such coating will be abraded by the traffic. Particularly in the case of use on cement concrete surfaces, it can be sensible also to make use of cubic reflecting bodies or reflecting bodies shaped in a manner of a polyhedron, which enhance the gripping properties, it being possible for the maximum dimensions thereof to be, as in the case of reflecting beads, preferably 0.4 mm to 6 mm.

The coloring of the reflecting bodies with discrete small areas of paint can preferably be performed such that the reflecting bodies are caused to fall out of a container and are sprayed as they fall with finely distributed paint, that is to say they are treated using the spray tower method. Glass beads can also be provided with spots of color using the stove-enamelling method; the advantages of this method can be rendered useful, in particular directly during the production process of the glass beads, for the purpose of applying the colored particles.

In order to produce reflecting bodies whose circumference is provided with only one, coherent film of paint covering approximately half the surface, the reflecting bodies are treated from one side with a jet of paint that is as homogeneous as possible.

Colored reflecting bodies according to the invention can also be used as a mixture with colorless reflecting bodies for the purpose of road marking, in particular on white lines.

I claim:

1. Reflecting bodies made from transparent material for mounting on traffic-bearing surfaces or traffic control surfaces, wherein the circumference of the reflecting bodies is partially covered by paint which defines a multiplicity of distributed, mutually separated colored surface regions, said colored surface regions being formed on said reflecting bodies prior to the mounting of the bodies on said surfaces, the paint-covered surface of a reflecting body being 30% to 70%, preferably approximately 50%, of the total surface of the reflecting body, the free surface that remains uncovered sufficing to cause incident light to enter the reflecting bodies with an intensity sufficient to produce retroreflection, and to exit from the reflecting bodies.

2. The reflecting bodies as claimed in claim 1, wherein colored surface regions of which more than half have a minimum extent of approximately 0.01 mm2.

3. The reflecting bodies as claimed in claim 2, wherein they have diameters of from 0.4 mm to 6 mm, preferably from 1.5 mm to 3 mm, and preferably consist of glass beads.

4. The reflecting bodies as claimed in claim 1 wherein they have the shape of a polyhedron.

5. The reflecting bodies as claimed in claim 1, wherein one and the same reflecting body has colored surface regions of different color.

6. An application of reflecting bodies as claimed in claim 1, wherein reflecting bodies are introduced into the surface of the pavement of roads or other traffic-bearing surfaces or are mounted on horizontal markings.

7. A method for producing reflecting bodies as claimed in claim 1, wherein reflecting bodies are caused to fall out of a container and are sprayed as they fall with finely-distributed paint, in particular using the spray tower method.

* * * * *